US006197253B1

(12) United States Patent
Broomfield et al.

(10) Patent No.: US 6,197,253 B1
(45) Date of Patent: Mar. 6, 2001

(54) LEAD-FREE AND CADMIUM-FREE WHITE METAL CASTING ALLOY

(76) Inventors: Allen Broomfield, 81 Briarcliffe Rd., Cranston, RI (US) 02910; Everett George Morrissey, 304 Cole St., Seekonk, MA (US) 02771

( * ) Notice: Subject to any disclaimer, the term of this patent is extended or adjusted under 35 U.S.C. 154(b) by 0 days.

(21) Appl. No.: 09/217,848

(22) Filed: Dec. 21, 1998

(51) Int. Cl.[7] ..... C22C 13/02
(52) U.S. Cl. ..... 420/562; 420/561
(58) Field of Search ..... 420/562, 561, 420/576, 577

(56) References Cited

U.S. PATENT DOCUMENTS

| | | | | |
|---|---|---|---|---|
| 3,864,150 | | 2/1975 | Baird et al. | 117/71 |
| 3,870,513 | | 3/1975 | Darnell et al. | 75/175 |
| 3,989,515 | | 11/1976 | Reiff | 75/172 |
| 4,214,903 | | 7/1980 | Murabayashi et al. | 75/134 |
| 4,373,974 | | 2/1983 | Barajas | 148/24 |
| 4,432,794 | | 2/1984 | Holleck | 75/239 |
| 4,452,866 | | 6/1984 | Kamiya et al. | 428/653 |
| 4,670,217 | | 6/1987 | Henson et al. | 420/562 |
| 4,695,428 | | 9/1987 | Ballentine et al. | 420/561 |
| 4,758,407 | | 7/1988 | Ballentine et al. | 420/560 |
| 4,778,733 | | 10/1988 | Lubrano et al. | 428/647 |
| 4,806,309 | * | 2/1989 | Tulman | 420/562 |
| 4,810,308 | | 3/1989 | Eagar et al. | 148/158 |
| 4,904,577 | * | 2/1990 | Tyan et al. | 430/495 |
| 4,929,423 | | 5/1990 | Tucker et al. | 420/561 |
| 5,134,039 | | 7/1992 | Alexander et al. | 428/614 |
| 5,137,685 | | 8/1992 | McDevitt et al. | 420/477 |
| 5,223,347 | | 6/1993 | Lhymn et al. | 428/614 |
| 5,229,070 | | 7/1993 | Melton et al. | 420/557 |
| 5,242,658 | | 9/1993 | Stevens et al. | 420/557 |
| 5,248,476 | | 9/1993 | Slattery et al. | 420/577 |
| 5,256,370 | | 10/1993 | Slattery et al. | 420/557 |
| 5,279,787 | | 1/1994 | Oltrogge | 419/38 |
| 5,288,458 | | 2/1994 | McDevitt et al. | 420/477 |
| 5,320,272 | | 6/1994 | Melton et al. | 228/180.21 |
| 5,328,660 | | 7/1994 | Gonya et al. | 420/562 |
| 5,344,607 | * | 9/1994 | Gonya et al. | 420/562 |
| 5,414,303 | | 5/1995 | Gonya et al. | 257/772 |
| 5,427,865 | | 6/1995 | Mullen, III et al. | 428/559 |
| 5,429,689 | * | 7/1995 | Shangguan et al. | 148/400 |
| 5,435,857 | * | 7/1995 | Han et al. | 148/24 |
| 5,455,004 | | 10/1995 | Slattery et al. | 420/562 |
| 5,538,686 | | 7/1996 | Chen et al. | 420/557 |
| 5,730,932 | | 3/1998 | Sarkhel et al. | 420/562 |
| 5,733,501 | * | 3/1998 | Takao et al. | 420/562 |
| 5,851,482 | * | 12/1998 | Kim | 420/557 |

FOREIGN PATENT DOCUMENTS

| | | | |
|---|---|---|---|
| 62230493A | * | 10/1987 | (JP) . |
| 2911874B | * | 6/1999 | (JP) . |

* cited by examiner

*Primary Examiner*—Daniel J. Jenkins
*Assistant Examiner*—Nicole Coy
(74) *Attorney, Agent, or Firm*—Banner & Witcoff, Ltd.

(57) ABSTRACT

An alloy comprising tin, antimony, bismuth and indium and a method for making the same is disclosed. The alloy is used in the hardware, jewelry, statuary, filigree, or other ornament casting art. A preferred embodiment of the alloy comprises 97% by weight tin, 1% by weight antimony, 1% by weight bismuth, and 1% by weight indium.

20 Claims, No Drawings

LEAD-FREE AND CADMIUM-FREE WHITE METAL CASTING ALLOY

FIELD OF THE INVENTION

The present invention is directed to a lead-free and cadmium-free alloy and method for making the same. More particularly, the invention is directed to a lead- free and cadmiumn-free casting alloy for making, for example, jewelry, statuary, hardware, or other cast objects including ornamental pieces and the like.

Description of the Related Art

In the alloy casting art for making pieces such as hardware, jewelry, statuary, or other ornamental pieces, it is advantageous for the casting alloy to have certain desirable properties and/or characteristics. Such properties include, but are not limited to: (1) a hypo-allergenic quality, (2) a non-toxic quality, (3) low temperature castability, (4) traceability (e.g., to its source by its composition), (5) reduces wear and tear on molds (e.g., an alloy that extends the life of a black rubber mold over 60–100 castings, preferably indefinitely), (6) crimpable without breakage, (7) polishable to a high gloss finish or luster, (8) tarnish resistant, (9) quick to solidify (e.g., exhibits a spin time shorter than that of conventional lead-pewter alloys on a centrifical casting machine), (10) high fluidity (ie., fluidity or flow sufficient to fill a mold without porosities, but sufficient to avoid flash formation—excess liquidus alloy that has crept between adjacent essentially flattened portions of mold halves creating an essentially flat undesirable flange circumscribing the cast piece or portion thereof), (11) dross or slag resistant (ie., does not form rust, dirt, oxides, heat streaking or the like on the surface of the molten alloy), (12) consistently reproducible castability (e.g., which is essentially free of voids and porosity defects), and (13) usable with a black rubber mold.

Unless otherwise indicated, the percentages recited below are by weight, based on the total weight of the alloy. U.S. Pat. No. 3,870,513 discloses a white metal alloy (i.e., an alloy having a tin content of at least about 90%) comprising 90.5–92.5% tin, 2.9–3.1% antimony, 1.4–1.6% cadmium and 3.3–3.7% lead. This alloy is neither lead or cadmium free. As these metals are known to be toxic, such an alloy does not provide one or more of the aforementioned desirable properties and/or characteristics.

U.S. Pat. No. 4,758,407 discloses lead-free and cadmium-free tin- and tin/antimony-based solder alloys. The non-toxic tin-based solder composition comprises 92.5%–96.8% tin, 3.0–5.0% copper, 0.1–2.0% nickel and 0.0–5.0% silver. The non-toxic tin/antimony-based solder composition comprises 87.0–92.9% tin, 4.0–6.0% antimony, 3.0–5.0% copper, 0.0–2.0 nickel and 0.0–0.5% silver. These compositions are typically used for plumbing applications, wherein the solders are exposed to potable water. These alloys are not free of copper.

U.S. Pat. No. 4,806,309 discloses a lead-free solder composition for soldering plumbing joints. The lead-free solder composition comprises approximately 90% to 95% tin, approximately 3% to 5% antimony, approximately 1% to 4.5% bismuth, and approximately 0.1% to 0.5% silver.

U.S. Pat. No. 5,435,857 discloses a soldering composition for soldering components in electronic and microelectronic circuitry. The composition consists essentially of an alloy comprising tin, indium, antimony, silver and in the range of about 0.0% to about 10.5% bismuth.

U.S. Pat. No. 5,256,370 discloses a low melting point solder alloy comprising tin, silver and indium. The disclosed alloy is typically used in automated soldering operations. This alloy is lead-free. In the embodiments disclosed within this patent, the alloy contains from about 70% to about 92% tin, from about 1% to about 5% silver and from about 4% to about 35% indium. A preferred composition contains about 77.2% tin, about 2.8% silver, and about 20% indium.

U.S. Pat. No. 5,229,070 discloses a low temperature-wetting solder paste which comprises a mixture of first and second solder powders. The first solder is formed predominantly (at least 90%) of tin. The second powder is formed of a tin alloy containing indium or bismuth and has a melting temperature less than the first solder powder. This patent does not disclose suitability of such alloy paste for making jewelry, statuary or other ornaments.

U.S. Pat. No. 5,538,686 discloses a lead-free solder alloy of tin, indium and zinc (e.g., in a Sn-In-Zn weight ratio of 86:5:9) to which bismuth and/or antimony may be added. The alloy is directed to uses in industrial processes such as formation of interconnects and packaging of electronic devices.

The various desirable characteristics of a castable alloy include, but are not limited to: the lowest achievable liquidus temperature (e.g., of at least about 340° F., such as from about 340° F. to about 450° F., preferably about 340° F. or lower), readily fills molds (e.g., at a temperature from about 380° F. to about 425° F.) without voids, porosities, flash, dross or slag formation, burnout, heat streaking and the like.

An alloy essentially free of one or more of zinc, nickel, iron, lead, cadmium, silver, copper and aluminum is sought to avoid various toxicity and other problems associated with these metals when incorporated into an alloy for use in the casting art. To date, applicants are unaware of any lead-free and cadmium-free alloy which advantageously provide the above-noted desirable properties and characteristics.

Further, none of the aforementioned patents disclose an alloy which provides the above-noted desirable properties and/or characteristics of an alloy suitable for casting hardware, jewelry, statuary, filigree and other ornamental pieces. Therefore, there exists a need for such an alloy and for a method for making such an alloy which provides essentially all the aforementioned desirable properties and/or characteristics.

SUMMARY OF THE INVENTION

The invention is directed to a castable alloy for use in making hardware, jewelry, statuary, filigree, and/or other ornamental pieces which satisfies at least a plurality of the above-noted desirable properties and/or characteristics. The alloy is essentially free (e.g., at most, having only trace amounts) of zinc, nickel, iron, lead, cadmium, and aluminum. Further, the alloy is essentially free of copper and silver to the extent that the sum of any copper and any silver does not exceed about 0.5%.

As used herein, for example, the term "essentially free" with respect to lead (i.e., "lead-free") means that the alloy or solder contains, at most, trace amounts of lead. As a guideline to the meaning of "essentially free of lead," see Federal Specification QQ-S-571E Interim Amendment 5 (ER) Dec. 28, 1989, paragraph 3.2.1.1.1, as approved by the Commissioner, Federal Supply Service, General Services Administration (lead should not exceed 0.2%). Of course, "essentially lead-free" also includes lead concentrations at or below 0.2%. For use in utensils such as flatware, forks, knives, spoons, plates, cups, other kitchenware, and the like, "essentially lead-free" means not to exceed about 0.02% (in lead content) or not to exceed the current maximum allowable lead content in such items (as set forth by the appropriate U.S. governmental agency in 1998).

Further, as described in column 2 of aforementioned U.S. Patent No. 4,806,309, a solder composition prepared according to the following percentage proportions by weight: tin-95%, antimony-3%, bismuth-1.5%, and silver-0.5%—was subjected to elemental analysis. The elemental analysis indicated that the above-noted alloy contained the following percentage proportions by weight of other elements: lead-0.060%, arsenic-0.036%, copper-0.034%, nickel-0.0066%, iron-0.0060%, cadmium-less than 0.005%, and indium-less than 0.003%. Additionally, because the detection limit for gold, aluminum and zinc was 0.005% or less of the methods used (as disclosed in U.S. Pat. No. 4,806,309), the alloy is said to be free of each of these metals Thus, for example, the above-noted composition of tin-95% (balance), antimony-3% (3.2% detected), bismuth-1.5% (1.49% detected) and silver (0.48% detected) would be considered to be "essentially free" of lead, arsenic, copper, nickel, iron, cadmium, indium, gold (none detected), aluminum (none detected), and zinc (none detected), respectively, in accordance with the term "essentially free" as defined herein. However, "essentially free" may include percentages above the exemplary trace amounts recited herein. Thus, "essentially free" may include other amounts that may be present, but which (1) do not interfere with the function of the present invention and (2) do not interfere with one or more of the desirable properties and/or characteristics noted herein.

The present invention also is directed to a process for forming an alloy of this invention.

In particular, an alloy in conformity with the present invention comprises:

(1) (a) tin; (b) antimony; (c) bismuth; and (d) indium, (2) wherein the alloy is essentially free of zinc, nickel, iron, lead, cadmium, and aluminum, and (3) wherein a sum of any copper and any silver does not exceed about 0.5%.

One embodiment of the invention is an alloy which provides the above-noted desirable properties and characteristics, which alloy comprises:

(a) from about 85% to about 97.5% tin;

(b) from about 1.0% to about 13.5% antimony;

(c) from about 1% to about 8% bismuth; and (d) from about 0.5 to about 8% indium.

According to another embodiment, the alloy of the present invention is at least essentially free of: zinc, nickel, iron, lead, cadmium, aluminum, and any copper together with any silver does not exceed about 0.5%. Preferably, to maintain a hypoallergenic quality and a non-toxic quality, the alloy is free or essentially free of all of the above-noted metals including zinc, nickel, iron, lead, cadmium, silver, copper and aluminum. In addition, the alloy of the present invention should be free or essentially free of other known toxic metals or those known to cause allergic reactions.

According to yet another embodiment, the alloy of the present invention comprises:

(a) from about 85% to about 97.5% tin;

(b) antimony;

(c) bismuth; and (d) indium, wherein the alloy is essentially free of zinc, nickel, iron, lead, cadmium, aluminum, wherein a sum of any copper and any silver does not exceed about 0.5%, and wherein the alloy exhibits a liquidus temperature from about 340° F. to about 450° F. However, a liquidus temperature below 340° F. would also be acceptable.

One or more of the above-noted embodiments may be made by the process comprising the steps of:

(a) providing a first quantity of tin;

(b) alloying a second quantity of antimony with said tin;

(c) alloying a third quantity of bismuth and a fourth quantity of indium with the alloyed tin and antimony; and (d) homogenizing the tin, the antimony, the bismuth, and the indium, wherein the alloying and homogenizing steps are performed at or above a liquidus temperature of a combination of two or more of tin, antimony, bismuth, and indium.

According to a further embodiment, the alloy of the present invention is made according to the process comprising the steps of:

(a) melting a first quantity of tin at about 550° F.;

(b) alloying a second quantity of antimony with the tin at about 750° F.;

(c) homogenizing the molten tin and the molten antimony;

(d) cooling the homogenized tin and antimony to a pot temperature of about 525° F.;

(e) introducing a third quantity of bismuth and a fourth quantity of indium to the cooled and homogenized tin and antimony; and (f) homogenizing the tin, the antimony, the bismuth and the indium, wherein the homogenized tin, antimony, bismuth, and indium exhibit a liquidus temperature of at least about 340° F.

DETAILED DESCRIPTION OF THE INVENTION

The present invention is an alloy comprising tin, antimony, bismuth, and indium, each element provided in a specified amount. As previously noted, unless indicated otherwise, the percentages recited below indicate the percent by weight of the particular element, based on a total weight of the alloy.

"Liquidus temperature", as used herein, means the temperature at or above which the alloy is sufficiently fluid to be poured into and made into a cast. Preferably, for the purposes of the present invention, the alloy is liquefied at a temperature sufficient to (1) meet a plurality of the aforementioned desirable properties and/or characteristics and (2) without the liquefied alloy suffering from dross and/or slag formation and/or burnout and/or heat streaking. Increased liquidus temperature of an alloy tends to accelerate the wear and tear on a black rubber mold, increases the energy and time required to liquefy the alloy, increases the spin-time in a centrifical mold apparatus typically used for proper casting, increases the cooling time and increases the overall cost of making a cast from such an alloy.

An alloy essentially free of one or more of zinc, nickel, iron, lead, cadmium, silver, copper and aluminum is sought to avoid various toxicity and other problems associated with these metals when incorporated into an alloy for use in the pertinent casting art.

In the jewelry and other ornament casting art, it is often undesirable to include copper within the alloy because copper is a known allergen, copper undesirably increases the melting point or liquidus temperature of the alloy, causes undesirable porosity, and often produces undesirable green copper oxide stains. Above about 0.5%, copper undesirably increases the porosity, increases the hardness and increases the liquidus temperature of an alloy. Thus, it is disadvantageous to include copper above about 0.5% in an alloy for use in the jewelry or other ornament casting art.

Likewise, above about 0.5%, inclusion of silver is not desirable because it readily oxidizes to a dark color, increases the porosity, increases the hardness, and increases the melting point or liquidus temperature of the alloy. Further, when used in combination, for avoiding the aforementioned disadvantages associated with copper and silver, the sum of any copper and any silver within an alloy should not exceed about 0.5% (e.g., should not exceed about 0.01%, 0.02%, 0.03%, 0.04%, 0.05%, 0.1%, 0.15%, 0.2%, 0.25%, 0.3%, 0.35%, 0.4%, 0.45%, etc., respectively)

The use of zinc is undesirable as a component of an alloy used for making jewelry and other ornamental castings. Above trace amounts, zinc is incompatible with tin (for use in an alloy intended for casting jewelry and other ornamental pieces) because zinc causes porosity and increases the liquidus temperature of an alloy.

As set forth above, it is undesirable to include copper, silver and zinc in an alloy. Like zinc, above trace amounts, iron, nickel and aluminum cause porosity and increase the liquidus temperature of an alloy. Further, above trace amounts, aluminum is incompatible with tin for inclusion in an alloy intended for casting into jewelry and other ornamental pieces such as statuary, filigree, and the like. As noted, lead and cadmium are too toxic to be included in an alloy above allowable (as determined by the relevant U.S. governmental agencies) amounts.

Further, a high concentration of antimony brittles an alloy and reduces its malleability. Without being bound by theory, it is believed that an excess of antimony renders an alloy prone to cracking and/or breaking. Thus, it is undesirable to include an excess of antimony in an alloy intended for use in casting jewelry or other pieces including statuary, hardware, filigree or the like.

Bismuth in excess (in an alloy) leads to unwanted expansion and cracking or breaking of a surface plating layer. However, a deficiency in bismuth causes surface defects such as a grainy texture, voids, and porosities, each of which is undesirable.

It is believed that indium acts like a binder for the other alloy components. As such, it is believed that indium increases the malleability (or decreases the brittleness) of the resulting alloy and helps prevent a solidified piece of the alloy from cracking. In addition, indium decreases the melting point or liquidus temperature of the alloy. However, excess indium yields an alloy that is too soft. Also, because indium is expensive, it is desirable to use as little indium as possible to form a competitively priced alloy.

Tin (Sn) forms the base metal of the alloy composition of the present invention. Tin is selected as the base metal because of its low melting point, non-toxicity, low cost, and facile castability. Tin is provided in the alloy of the present invention in an amount sufficient to function as a base amount to which other alloy components may be added. Further, tin is used in an amount as a base metal sufficient to lower the liquidus temperature of the alloy, preferably to about 340° F. As noted above, tin is also used because it is inexpensive and non-toxic. Typically, the amount of tin present within the alloy of the present invention is from about 85% to about 97.5%, more typically from about 90% to about 97.5%, even more typically from about 92% to about 97.4%, preferably from about 94% to about 97.3%, more preferably from about 95% to about 97.2%, even more preferably from about 96% to about 97.1%, and most preferably from about 96.9% to about 97.0%.

Without being bound by theory, it is believed that antimony (Sb) acts as a hardening agent within the alloy of the present invention. Further, it is believed that antimony increases the "sharpness" of the casting. This characteristic is also known as "points" the casting. As an example, it is believed that in the absence of antimony, an alloy of tin, bismuth and indium would be prone to forming rounded comers. For example, without antimony, if a pyramid were cast with only tin, bismuth, and indium within the alloy, then it is expected that the pyramid will have rounded comers. However, with the addition of an appropriate amount of antimony, the alloy would yield a pyramid cast having proper sharp, pointed comers. Further, as previously noted herein, it is generally believed that an excess of antimony typically would make the cast made therefrom excessively brittle, prone to heat streaking and would be subject to the other deleterious effects discussed herein.

In the alloy composition of the present invention, typically, antimony is provided in an amount sufficient to adequately increase the sharpness, to avoid rounded corners and to form a pointed casting, and/or to increase the hardness of the casting while avoiding the problems associated with excess antimony. As such, the alloy of the 5 present invention typically comprises from about 1.0% to about 13.5% antimony, more typically from about 1.0% to about 5.0% antimony, even more typically from about 1.0% to about 4.0% antimony, preferably from about 1.0% to about 3.0% antimony, more preferably from about 1.0% to about 2.0% antimony, even more preferably from about 1.0% to about 1.5% antimony, and most preferably about 1.0% antimony.

In the alloy composition of the present invention, without being bound by theory, it is believed that bismuth (Bi) also promotes the hardness of the alloy, and the ability of the casting to expand both during addition of the alloy into the mold in a liquidus state and after solidification. If too little bismuth is included in the alloy, then it is believed that the casting will have a grainy surface. Again, without being bound by theory, it is believed that such grainy surface is due to a failure of the alloy in its liquidus state to properly fill and expand fully into the mold and a failure of the alloy to sufficiently expand thereafter during solidification within the mold to avoid formation of a grainy or otherwise defected surface. As such, voids and/or porosities are formed between the inner mold surface and the outer alloy surface of the cast within the mold. These conditions contribute to the formation of grainy, uneven and/or undesirable surfaces on the casting made with an alloy deficient in bismuth. Further, too little bismuth causes the resulting alloy to poorly fill in fine casting work such as filigree ornamentation often encountered in the jewelry or other ornament making trade.

However, as previously noted herein, it is also believed that if too much bismuth is included within the alloy, the casting made therefrom is prone to excessive expansion, both during solidification from a liquidus state within a mold as well as expansion after stiffening into a solidified state. Thus, for example, a plated casting made from an alloy containing too much bismuth is expected to cause the plating to crack and/or break due to undesirable expansion of the cast even after it has been removed from the mold in solid form. Consequently the piece becomes unsightly and undesirable.

Accordingly, the concentration of bismuth in an alloy of the invention is selected to be sufficient to adequately fill a mold (to conform to the mold shape) with the casting alloy while avoiding the problems associated with excess bismuth. Thus, the metal alloy of the present invention comprises, typically, from about 1% to about 8% bismuth, more typically from about 1% to about 5% bismuth, even more typically from about 1% to about 4% bismuth, preferably from about 1% to about 3% bismuth, more preferably from about 1% to about 2% bismuth, even more preferably from about 1% to about 1.5% bismuth, and most preferably about 1.0% bismuth.

As previously noted, without being bound by theory, it is believed that indium (In) "knits" the metal molecules of the alloy of the present invention. Alternatively stated, the indium acts like a binder. Indium binds the metal elements of the alloy composition of the present invention. As such, indium increases the malleability of a casting made from an alloy containing indium and reduces its brittleness. Indium also reduces the liquidus temperature of the alloy. It is believed that if an insufficient amount of indium is included in the alloy of the present invention, a casting made from such alloy is prone to cracking, excessive brittleness and the like. If too much indium is included in the alloy of the present invention, a cast from such an alloy is too soft, much like 24K gold. A cast that is too soft is prone to excessive bending, deformation and the like. Accordingly, indium is provided within the alloy of the present invention in an amount sufficient to increase the malleability, reduce the brittleness, reduce the tendency to crack and reduce the liquidus temperature of the alloy while avoiding the problems associated with excess indium. Thus, typically, the composition of the present invention comprises from about 0.50 to about 8% indium, more typically from about 0.6% to about 6% indium, even more typically from about 0.7% to about 5% indium, preferably from about 0.8% to about 3% indium, more preferably from about 0.9% to about 2% indium, and most preferably about 1.0% indium.

Further, the alloy of the present invention is free or essentially free ("essentially free" as defined herein) of at least a plurality of the following metals: zinc, nickel, iron, lead, cadmium, aluminum, copper, silver and the like. In accordance with the present invention, the alloy may contain no more than about 0.5% of a sum of any copper and any silver. Preferably, though, the alloy of the present invention is essentially, or completely free of the zinc, nickel, iron, lead, cadmium, aluminum, copper and silver.

The inventors have discovered that, surprisingly, the alloy of the present invention is not susceptible to heat streaking. In particular, no dross and/or slag formation or burnout is observed in the liquidus melt (between about 340° F. and 450° F.) containing tin, antimony, bismuth, and indium in accordance with the present invention.

Dross refers to oxides of the various metal components making up an alloy in its liquidus state. Typically, dross is observed as "scum" floating on the surface of the liquidus alloy melt. Slag refers to larger pieces of the oxides of the various metals forming on the liquidus alloy melt. Examples of dross and slag include, but are not limited to: rust, oxide layers, dirt, scum and the like (typically observed floating on the surface of the liquidus alloy melt).

A preferred embodiment of the claimed composition comprises 97% tin, 1% antimony, 1% bismuth, and 1% indium. Such preferred composition exhibits a liquidus temperature from about 340° F. to about 450° F., most preferably about 340° F. Typically, when heated above about 450° F., the alloy suffers from dross and/or slag formation, and/or excessive oxidation (i.e., burnout and/or heat streaking). Typically, such alloy is melted at a temperature from about 380° F. to about 400–420° F. to form a liquidus melt thereof for casting into a desired shape. A preferred alloy of the present invention is essentially free of dross and/or slag formation at the liquidus temperature.

To form a cast, the metals comprising the alloy are melted and homogenized to form the alloy. Thereafter, the alloy is heated to or above its liquidus temperature. Preferably, the alloy is heated to a temperature as low as possible above the liquidus temperature of the alloy. Thereafter, it is transferred to a mold (e.g., a black rubber mold or the like). The mold is secured and spun at an appropriate spin rate. The spin rate should be sufficient to fill the mold with the alloy while avoiding void, porosity, and flash formation. If too high a spin rate is used, flash formation may occur even if enough "non-flashing" dopant is present. The larger the piece, the slower the spin rate necessary to form a proper casting. Typically, a spin rate from about 390 rpm to about 450 rpm is suitable for making jewelry, hardware, statuary, filigree and the like. However, the spin rate may be adjusted as would be recognized by one of ordinary skill in the relevant casting art.

The following example is provided for illustrative purposes only. It is not intended to limit the scope of the present invention. Accordingly, variations of the various parameters (e.g., temperature values, percentages by weight, spin rates, spin times, and the like, etc.) may be made without departing from the scope and spirit of the present invention.

EXAMPLES

Example 1

An alloy composition in accordance with one embodiment of the present invention was formed. In particular, the alloy composition recited below was prepared. The relative amounts of the various metals of the alloy composition were selected to yield the alloy composition noted below.

| Metal | Amount |
|---|---|
| Sn | 97% |
| Sb | 1% |
| Bi | 1% |
| In | 1%. |

The above-noted alloy was prepared by the procedure indicated below. Tin was melted (m.p. of about 550° F.). Antimony (m.p. of about 750° F.) was added to the tin melt and was sufficiently heated to melt with the tin. Thereafter, the metals (Sn and Sb) were homogenized by mixing the molten metals. After homogenization, the Sn-Sb homogenized liquidus melt was allowed to cool to about 525° F. Thereafter, the indium and bismuth were introduced into the cooled Sn-Sb homogenate. These elements were mixed with a hand mixture until a Sn-Sb-Bi-In liquidus homogenate alloy was formed. The addition of the bismuth and the indium to the Sn-Sb homogenate reduced the liquidus temperature of the alloy composition to about 340° F. Accordingly, the Sn-Sb-Bi-In alloy was ready to pour at or above 340° F.

At this point, the Sn-Sb-Bi-In liquidus alloy was ready to be poured into a mold to form a cast. To form the cast, the Sn-Sb-Bi-In alloy was brought to a temperature of about 380° F. At about 380° F., the liquidus alloy was at a temperature sufficient to be poured or added by a ladle into the mold without having it solidify in the ladle. The liquidus alloy was ladled into a black rubber mold (available from Conley, Inc. of Warwick, R.I.) and spun in a centrifical casting machine (available from Contenti, Inc. of Providence, R.I.) for a spin time of 1 minute and 10 seconds at a spin rate of about 390 rpm. The spin time of 1 minute and 10 seconds is substantially lower than a spin time of about 8 minutes required with conventional pewter to make a 4 inch sailor cast of the type made in accordance with this example. At the 390 rpm spin rate, no flash formation occurred.

Using this alloy, at about °380 F., castings of earrings, a penny sized elephant head, a golf club having settings for stones, a 2½-inch golf club shaft, a perfume bottle holder having a lot of fine filigree work on it (which typically surrounds a perfume bottle), and a 4inch sailor figurine weighing about ⅓ pound were made. All casts made were fully formed. No voids, porosities, heat streaking, dross or slag formation, flash formation, or other surface or structural defects were present All the casts made satisfied industry standards for making jewelry, statuary, and filigree casts of the type made.

It was noted that because the above-noted alloy was castable at a low temperature (e.g., from about 340° F. to about 380° F.), the alloy did not burn the rubber mold.

All patents and publications recited in this application are incorporated herein by reference in their entirety.

It will be apparent to those skilled in the art that various modifications and variations can be made in the compositions and methods of the present invention without departing from the spirit or scope of the invention. Thus, it is intended that the present invention cover the modifications and variations of this invention provided they come within the scope of the appended claims and their equivalents.

What is claimed is:

1. An alloy composition comprising:

(a) tin;

(b) antimony;

(c) bismuth; and (d) from about 0.5 to about 8% indium, wherein the alloy is essentially free of zinc, nickel, iron, lead, cadmium, and aluminum, and wherein a sum of any copper and any silver does not exceed about 0.5%, based on a total weight of the alloy.

2. The alloy of claim 1, wherein said tin is present in an amount from about 85% to about 97.5% by weight, based on a total weight of the alloy.

3. The alloy of claim 2, wherein said tin is present in an amount from about 96% to about 97.1% by weight, based on said total weight of the alloy.

4. The alloy of claim 3, wherein said tin is present in an amount from about 96.9% to about 97.0% by weight based on said total weight of the alloy.

5. The alloy of claim 1, wherein said antimony is present in an amount from about 1.0% to about 13.5% by weight, based on a total weight of the alloy.

6. The alloy of claim 5, wherein said antimony is present in an amount from about 1.0% to about 2.0% by weight, based on said total weight of the alloy.

7. The alloy of claim 6, wherein said antimony is present in an amount of about 1.0% by weight based on said total weight of the alloy.

8. The alloy of claim 1, wherein said bismuth is present in an amount from about 1.0% to about 8.0% by weight, based on a total weight of the alloy.

9. The alloy of claim 8, wherein said bismuth is present in an amount of about 1.0% by weight, based on said total weight of the alloy.

10. The alloy of claim 1, wherein said indium is present in an amount from about 0.5% to about 8% by weight, based on a total weight of the alloy.

11. The alloy of claim 10, wherein said indium is present in an amount of about 1.0% by weight, based on said total weight of the alloy.

12. An alloy composition comprising:

(a) tin;

(b) antimony;

(c) bismuth; and (d) from about 0.5 to about 8% indium, wherein the alloy has a liquidus temperature of at least about 340° F., and wherein a sum of any copper and any silver does not exceed about 0.45%, based on a total weight of the alloy.

13. The alloy of claim 12, wherein said liquidus temperature is about 340° F. and wherein said tin is present in an amount of about 97% by weight, said antimony is present in an amount of about 1% by weight, said bismuth is present in an amount of about 1% by weight, and said indium is present in an amount of about 1% by weight, based on a total weight of the alloy, respectively.

14. An alloy composition comprising:

(a) tin;

(b) antimony;

(c) bismuth; and (d) from about 0.5 to about 8% indium, wherein the alloy is essentially free of zinc, nickel, iron, lead, cadmium, and aluminum, and wherein a sum of any copper and any silver does not exceed 0.45%, based on a total weight of the alloy.

15. The alloy of claim 14, wherein said tin is present in an amount from about 96% to about 97.1% by weight, based on said total weight of the alloy.

16. The alloy of claim 14, wherein said bismuth is present in an amount from about 1.0% to about 8.0% by weight, based on a total weight of the alloy.

17. An alloy composition comprising:

(a) tin;

(b) antimony;

(c) bismuth; and (d) from about 0.5 to about 8% indium, wherein the alloy has a liquidus temperature of at least about 340° F., and wherein a sum of any copper and any silver does not exceed 0.5%, based on a total weight of the alloy.

18. The alloy of claim 17, wherein said antimony is present in an amount from about 1.0% to about 2.0% by weight, based on said total weight of the alloy.

19. An alloy composition consisting essentially of:

(a) tin;

(b) antimony;

(c) bismuth; and (d) from about 0.5 to about 8% indium, wherein the alloy is essentially free of zinc, nickel, iron, lead, cadmium, and aluminum, and wherein a sum of any copper and any silver does not exceed 0.5%, based on a total weight of said composition.

20. An alloy composition consisting of:

(a) tin;

(b) antimony;

(c) bismuth; and (d) from about 0.5 to about 8% indium.

* * * * *